US005381614A

United States Patent [19]

Goldstein

[11] Patent Number: 5,381,614

[45] Date of Patent: Jan. 17, 1995

[54] AIM IMPROVING SELF-ALIGNING GOLF SHOES

[76] Inventor: Marc Goldstein, 407 E. 91st St., Apt. 5F, New York, N.Y. 10128

[21] Appl. No.: 167,339

[22] Filed: Dec. 15, 1993

[51] Int. Cl.[6] ..... A43B 5/00; A43B 5/18

[52] U.S. Cl. ..... 36/127; 36/1; 36/114; 36/132; 36/136

[58] Field of Search ..... 36/1, 8.4, 77 R, 45, 36/114, 127, 132, 136, 72 R

[56] References Cited

U.S. PATENT DOCUMENTS

| | | | |
|---|---|---|---|
| D. 97,524 | 8/1935 | Geayer . | |
| 801,899 | 10/1905 | McQuiston . | |
| 1,872,025 | 8/1932 | Baynard et al. . | |
| 2,260,138 | 10/1941 | Feinberg | 36/127 |
| 2,503,586 | 4/1950 | Miller | 36/127 |
| 3,122,846 | 3/1964 | Trent . | |
| 3,229,981 | 1/1966 | Taber . | |
| 3,420,529 | 1/1969 | Goranson et al. . | |
| 4,073,075 | 2/1978 | O'Brien . | |
| 4,333,248 | 6/1982 | Samuels | 36/72 R |
| 4,819,940 | 4/1989 | Davis . | |
| 4,953,311 | 9/1990 | Bruggmeier . | |
| 5,074,060 | 12/1991 | Brncick et al. | 36/77 R |
| 5,150,903 | 9/1992 | Percic . | |
| 5,163,686 | 11/1992 | Bergman | 273/187 A |
| 5,212,894 | 5/1993 | Paparo . | |

*Primary Examiner*—Paul T. Sewell
*Assistant Examiner*—Marie Denise Patterson
*Attorney, Agent, or Firm*—Lerner, David, Littenberg, Krumholz & Mentlik

[57] ABSTRACT

A pair of golf shoes for aiding a golfer in establishing an optimal stance and improving the golfer's aim during driving and iron shots is disclosed. The golf shoes comprise an upper portion and a sole portion. The upper portion includes visual alignment guide lines thereon for aiding a golfer in establishing relative positioning of the golfer's feet with respect to each other, the golf ball and the target.

12 Claims, 9 Drawing Sheets

AIM IMPROVING SELF-ALIGNING GOLF SHOES

FIELD OF THE INVENTION

The present invention relates to a device for optimizing a golf stance to improve a golfer's aim. More particularly, the present invention relates to self-aligning golf shoes which enable a player to obtain an optimal stance and thus, improved aim during driving and iron shots.

BACKGROUND OF THE INVENTION

Golf has been a popular sport throughout the world for many years. Its popularity has been steadily increasing both in the United States and abroad. As such, golfers have continuously strived to lower their scores by increased practice time and by purchasing various accessories which may give them advantageous results over competing players.

One particular area which golfers continuously strive to improve is their aim. Although the golf swing is made up of several elements including initially obtaining a proper stance, concentration during the downswing, proper shifting of a player's weight and the follow through, the basis for achieving a successful golf swing and accurate aim is first obtaining an optimal stance. As evidenced by the crowded nature of the golf training art, inventors have expended great efforts in developing golf swing training aids and aim improvement devices including devices for aiding golfers in obtaining a proper stance during driving and iron shots.

Despite the crowded nature of the prior art, all of the known devices have drawbacks which render them undesirable or illegal for use during play. In this regard, several known golf training devices include a wedge-shaped device which is adapted to be connected to the outer portion of the sole of a golfer's shoe. These illegal devices are generally used to cant one of the golfer's feet to facilitate proper shifting of a golfer's body weight during the swing. Such devices are disclosed in U.S. Pat. Nos. 4,819,940 to Davis and 4,073,375 to O'-Brien.

Still other attempts at improving a golfer's stance are evidenced by prior art devices that are adapted to be fastened to the heel of a golf shoe, such as the illegal device disclosed in U.S. Pat. No. 5,150,903 to Percic.

The prior art also includes inserts for golf shoes which cause a golfer's foot to be canted either to the left or to the right for the purpose of improving a golfer's balance by shifting of the golfer's body weight and body position during a golf swing. Examples of the illegal insert-type devices are disclosed in U.S. Pat. Nos. 5,212,894 to Paparo and 4,953,311 to Bruggemeier.

External feet positioning indicators which may be useful for illustrating the proper positioning of a golfer's feet during practice, have also been proposed to aid a golfer in obtaining an optimal stance. These devices are not generally used during play as they are too awkward to carry around for use on a golf course. Examples of such devices are disclosed in U.S. Pat. Nos. 3,229,981 to Taber and 3,122,846 to Trent.

Putting aids have also been disclosed in the prior art to facilitate the alignment of a golf shoe with a golf ball so that a golfer's putting ability may be enhanced. An example of such a device is disclosed in U.S. Pat. No. 2,503,586 to Miller. Although this device may be useful for putting purposes, it has no use whatsoever for driving and iron shots as it does not facilitate positioning of the golfer's feet relative to each other.

All of the foregoing prior art devices which are intended to improve a golfer's swing during driving and iron shots, have the major drawback of being illegal under PGA rules. In particular, the PGA rules do not permit golfers to use any physical aids for improving their swing to lower their golf score.

The present invention solves the aforementioned drawbacks of the prior art by providing means for aiding a golfer in obtaining an optimal golf stance during driving and iron shots so that the golfer's aim may be improved. Additionally, the present invention is useful during practice and official play, as it meets all requirements of the PGA rules.

SUMMARY AND OBJECTS OF THE INVENTION

One aspect of the present invention pertains to a pair of golf shoes for aiding a golfer in establishing relative positioning of his or her feet with respect to the ball and with respect to each other so that an optimal stance may be obtained to improve the golfer's aim during driving and iron shots. Each of the golf shoes comprises an upper portion and a sole portion. The upper portion of each of the golf shoes includes a central longitudinal axis extending lengthwise through the center thereof and alignment means arranged on the upper portion of at least one of the golf shoes. The alignment means may include indicia having a predetermined orientation offset from a corresponding one of the central longitudinal axes.

The one preferred embodiment, the alignment means of the golf shoes may include a first set of perpendicular longitudinal and transverse linear indicia arranged on the upper portion of the right golf shoe, and a second set of perpendicular longitudinal transverse linear indicia arranged on the upper portion of the left golf shoe. The first and second sets of perpendicular linear indicia are preferably offset from each other when the central longitudinal axis of the left and right golf shoes are placed parallel to each other. When the golfer's feet are placed in the optimal stance, the first and second sets of perpendicular linear indicia are adapted to be arranged such that the respective longitudinal and transverse linear indicia thereof are placed parallel to each other. The first and second sets of perpendicular longitudinal and transverse linear indicia may comprise one longitudinal line and one transverse line, or may comprise a plurality of longitudinal or transverse lines. Preferably, the one or more transverse lines will be in alignment with the intended target area when the golf shoes are arranged in the optimal position.

In another preferred embodiment, the alignment means of the golf shoes includes at least one first straight line arranged in a predetermined position on the upper portion of the right golf shoe, and at least one second straight line arranged in a predetermined position on the upper portion of the left golf shoe. The at least one first straight line and the at least one second straight line define corresponding first and second axes which are disposed to intersect each other when the golf shoes are placed parallel to each other, and are adapted to be arranged parallel to each other when the golfer's feet are placed in the optimal stance.

In still another preferred embodiment, the at least one second straight line may be offset from the central longitudinal axis of the left golf shoe at an angle of about 22½°, and the at least one first straight line is arranged to extend coaxial with the central longitudinal axis of the right shoe so that a right handed golfer can obtain the Hogan stance upon placing of the golf shoes in the optimal position.

In still another preferred embodiment, the at least one first straight line would be offset from the central longitudinal axis of the right golf shoes at an angle of about 22½°, and the at least one second straight line is arranged to extend coaxial with the central longitudinal axis of the left golf shoe so that a left handed golfer can obtain the Hogan stance upon placement of the golf shoes in the optimal position.

In another preferred embodiment, the at least one first and second straight lines may be offset from corresponding ones of the central longitudinal axes of the respective left and right golf shoes at an angle of about 27½° so that a golfer can obtain the Leadbetter stance upon placement of the golf shoes in the optimal position.

The alignment means of the golf shoes of the present invention may also include connection means for selective attachment and detachment to corresponding upper portions of the golf shoes.

According to another preferred embodiment, the golf shoes of the present invention may comprise detachable shield means connectable to the upper portion of the golf shoes for selectively covering the alignment means thereon. The detachable shield means may include putting alignment means arranged thereon for facilitating alignment of a golf ball in a selected one of the golf shoes to optimize a golfer's aim during putting. The putting alignment means may include at least one longitudinal line arranged on the upper portion of at least one of the golf shoes whereby the golfer's putting stroke is optimized by aligning the at least one longitudinal line with a golf ball prior to putting. The putting alignment means may also include at least one transverse line perpendicular to the at least one longitudinal line.

An alternate preferred embodiment, the detachable shield means may include an arbitrary design, or may not include any indicia whatsoever.

According to another aspect of the present invention, a method is disclosed for aiding a golfer in selecting an optimal stance to maximize the golfer's aim during driving and iron shots. One preferred method comprises the steps of selecting a desired location in which to place the golfer's feet with respect to a golf ball; utilizing alignment means including indicia arranged on the upper portion of golf shoes to select positions in which to place a golfer's feet relative to a target, each other and to the golf ball, and placing both feet in the selective position so that the alignment means will indicate when an optimal stance has been obtained.

Preferably, the alignment means according to the preferred method comprises a plurality of alignment lines, and the step of placing both feet in the selected positions comprises arranging the golf shoes in a relative position with respect to each other so that respective ones of the plurality of lines of each of the golf shoes are arranged parallel to each other and to a central reference axis extending perpendicular to an axis which extends between the golfer's feet and the target.

In another preferred embodiment, the plurality of alignment lines may comprise a pair of perpendicular lines arranged on each of the golf shoes, and the step of arranging the golf shoes in a relative position with respect to each other comprises aligning respective ones of the pair of perpendicular lines with each other so that longitudinal and transverse lines thereof extend parallel to each other and with the central reference axis extending perpendicular to an axis which extends between the golfer's feet and the target. In this preferred embodiment, the transverse lines may be arranged in a predetermined position so that they are placed in alignment with a target area when an optimal stance has been obtained.

Accordingly, it is an object of the present invention to provide a pair of golf shoes including means for aiding an golfer in obtaining a optimal stance during driving and iron shots so that the golfer's aim may be improved. It is a further object of the present invention to provide a pair of golf shoes which may be used to aid a golfer in obtaining an optimal stance during driving and iron shots that meet all of the requirements of the PGA so that they can be used during official play.

It is still another object of the present invention to provide a pair of golf shoes including means for placing them in a relative position with respect to a target, each other and with respect to a golf ball to aid a golfer in obtaining an optimal stance during driving and iron shots.

The above Summary as well as further objects, features, and advantages of the present invention will be more fully understood with reference to the following detailed description of the self-aligning golf shoes, when taken in conjunction with the accompanying drawings described below.

DETAILED DESCRIPTION OF THE PREFERRED EMBODIMENTS

Figure 1:
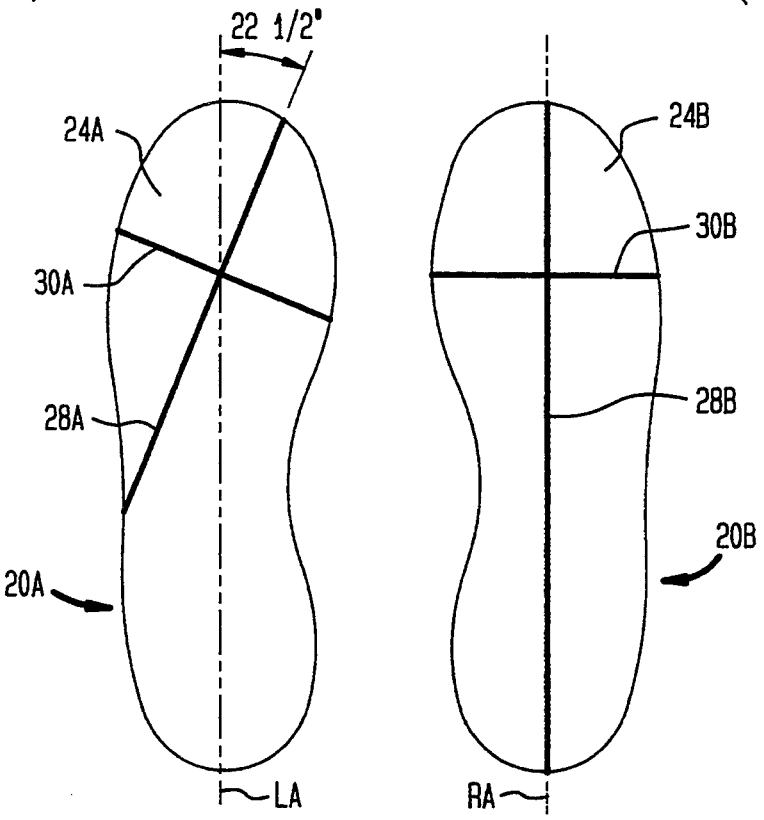
FIG. 1 is a top plan view of one preferred embodiment of the golf shoes of the present invention for a right handed player before assuming a desired stance.
Figure 2:
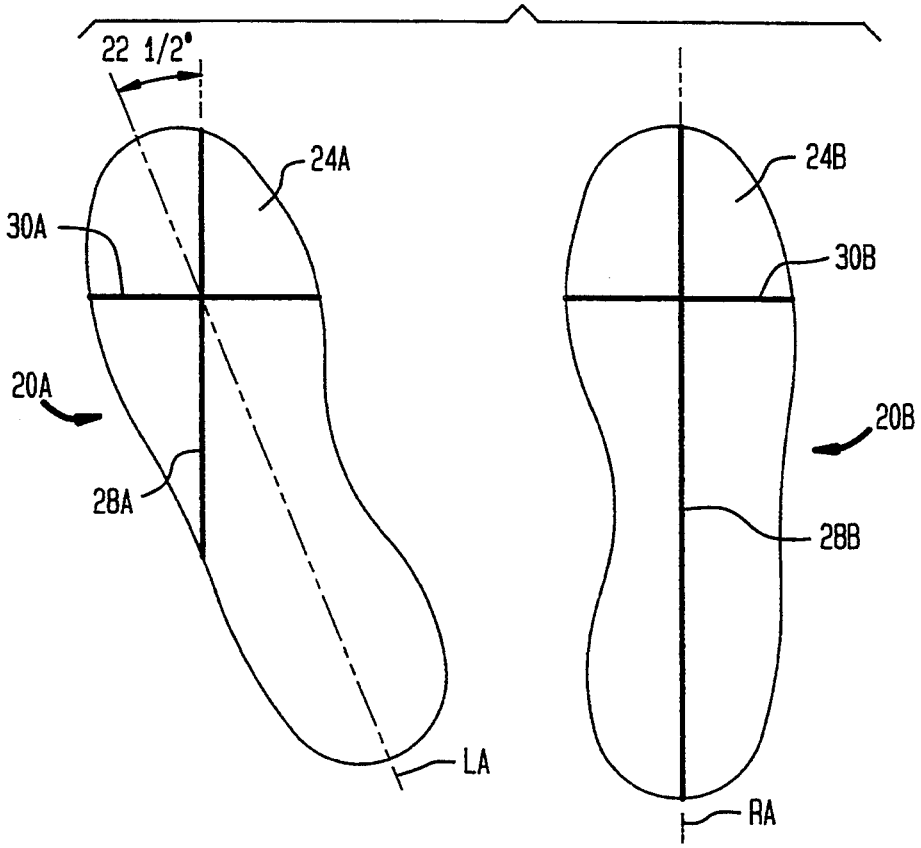
FIG. 2 is a top plan view of the golf shoes shown in FIG. 1 after the player's feet are placed in the desired stance.
Figure 3:
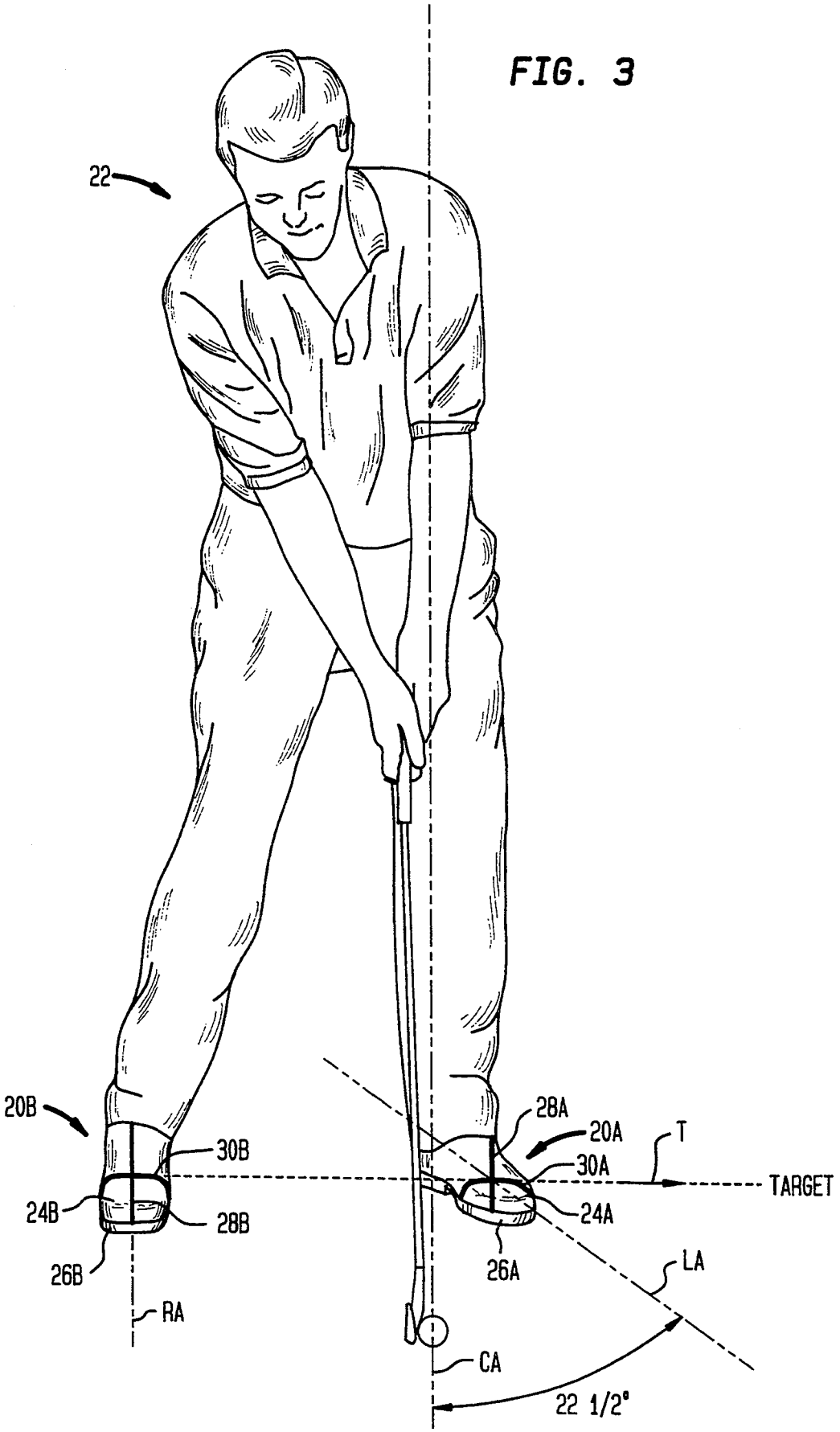
FIG. 3 is a perspective view of the golf shoes shown in FIG. 2 in use by a golfer.

In accordance with one preferred embodiment of the present invention, a pair of golf shoes including a left golf shoe 20A and a right golf shoe 20B are generally shown in FIGS. 1–3. The golf shoes are intended to be worn by a golfer 22 to facilitate consistently achieving an optimal stance to improve the golfer's aim during driving and iron shots.

As discussed in this application, the terms "driving and iron shots" are intended to include all shots made with drivers, traditional irons including No. 2–9 irons, a pitching wedge, and all clubs useful for chipping shots. Thus, driving and iron shots include golf shots made with all clubs except putters.

It should be understood that the golf shoes of the present invention are intended to be used as an aid by golfers of all skill levels in acquiring an appropriate stance prior to hitting a golf ball. In this regard, the golf shoes disclosed in FIGS. 1–9 include visual lines thereon to indicate when a golfer 22 has obtained one of two popular golf stances, i.e., the Hogan and Leadbetter stances. However, these stances are merely preferred stances in accordance with the preferred embodiments of the present invention and thus, are only intended to be examples of stances that may be obtained with the golf shoes of the present invention. Thus, the alignment lines on the golf shoes can be arranged in various positions to indicate when different preferred stances are obtained.

The golf shoes shown in FIGS. 1–3 are useful to help players of all skill levels to obtain the popular Hogan stance during driving and iron shots. The left golf shoe 20A includes an upper portion 24A and a sole portion 26A. Similarly, the right golf shoe 20B includes an upper portion 24B and a sole portion 26B. Thus, the support structure of the golf shoes of the present invention include the same basic components, i.e., a sole and an upper portion, as most of the athletic footwear that is already commercially available.

In the preferred embodiment shown in FIGS. 1–3, the left golf shoe 20A includes a longitudinal guide line 28A and a transverse guide line 30A. The transverse guideline 30A is arranged perpendicular to the longitudinal guide line 28A. A central longitudinal axis LA extends through the longitudinal center of the left golf shoe 20A as shown in phantom in FIG. 1.

The right golf shoe 20B also includes a pair of guide lines arranged on the upper portion 24B. In this regard, the right golf shoe 20B includes a longitudinal guide line 28B and a transverse guide line 30B arranged perpendicular thereto. Additionally, a central longitudinal axis RA is co-axially aligned with the longitudinal guide line 28B of the right golf shoe 20B.

The sole portions 26A and 26B of the respective left and right golf shoes may be made of a rubber material. However, the material of which the sole portions 26A and 26B are made is not essential to the patentable aspects of the present invention and thus, may comprise other suitable materials such as leather, rubber, plastic and the like. Similarly, the left and right upper portions 24A and 24B may be made of various material including leather, synthetic leather, canvas, vinyl, etc. The guide lines 28A and 30A of the left golf shoe 20A and the guide lines 28B and 30B of the right golf shoe 20B are intended to act as alignment means to provide a visual aid for a golfer 22 in establishing relative positioning of the golfer's feet relative to each other and to the ball so that an optimal stance may be obtained to improve the golfer's aim during driving and iron shots. The manner in which this will be accomplished will be discussed in detail below.

It should be appreciated that the guide lines in all embodiments of the present invention may be arranged on the upper portions 24A and 24B of the left and right golf shoes in any suitable manner. For example, the guide lines may be placed on the upper portion of the golf shoes by various colored dyes, sewn material, separable snap-on devices or loop and hook velcro connectors. These different ways of placing the guide lines on the upper portion of the golf shoes are intended to be examples only. Thus, the particular manner in which the guide lines are arranged on golf shoes is not intended to be limited by the description in this application. What is important, is that the guide lines are arranged in a manner that will clearly provide a visual aid to a golfer who wishes to obtain a particular stance.

As discussed above, the golf shoes 20A, 20B disclosed in FIGS. 1–3 are intended to aid a right handed golfer in establishing the Hogan stance during driving and iron shots. This is accomplished by arranging the longitudinal guide line 28A of the left golf shoe 20A in a position so that it will intersect the central longitudinal axis LA to form an angle of approximately 22½° therewith on the anterior side of the left golf shoe 20B, i.e., the side closest to the right golf shoe as shown in FIG. 1. The relative positioning of the longitudinal guide line 28A and the transverse guide line 30A is fixed. In the embodiment shown in FIGS. 1–3, the longitudinal guide line 28A will always remain perpendicular to the transverse guide line 30A regardless of the positioning of the left foot golf shoe 20A. The longitudinal guide line 28B and the transverse guide line 30B of the right golf shoe 20B will also be perpendicular to each other at all times.

The longitudinal guide line 28B of the right golf shoe 20B extends coaxial with the central reference axis RA. As with the left golf shoe 20A, the transverse guide line 30B of the right golf shoe 20B will always remain perpendicular to the corresponding longitudinal guide line 28B.

FIG. 2 illustrates an isolated top plan view of the left and right golf shoes after a right handed golfer 22 has obtained the Hogan stance in accordance with a preferred embodiment of the present invention. As clearly shown in FIG. 2, the left golf shoe 20A should be placed at an angle with respect to the right golf shoe 20B until the longitudinal guide line 28A and the transverse guide line 30A arranged on the upper portion 24A are in axes which extend parallel with the respective longitudinal guide line 28B and the transverse guide line 30B on the upper portion 24B of the right golf shoe 20B. When the respective left and right longitudinal and transverse guide lines are in alignment with each as shown in FIG. 2, the golfer 22 has a clear indication that he or she has obtained the desired stance.

In practice, a golfer will place his or her feet at a particular distance from a golf ball 32 prior to assuming an appropriate stance. The relative positioning of a golfer's body and feet with respect to the golf ball 32, and with respect to each other and the target, is shown in FIG. 3 which generally illustrates a golfer 22 who has used the golf shoes of the present invention to establish the popular Hogan stance.

For a right handed golfer, the golf ball 32 should be lined up with a desired location on the golfer's body along a central reference axis CA as shown in FIG. 3. Of course, different individuals will have different preferences with regard to the alignment between the golf ball 32 and a selected position on his or her body. For example, some right-handed golfers may prefer to align the golf ball 32 with his or her left armpit, while other golfers may align the golf ball with his or her left heel or other location. Of course, for a left handed golfer, the body position is reversed so that the golf ball 32 is generally arranged in alignment with a location on the right side of the golfer's body (not shown). Once this initial alignment is obtained, the golfer must determine how to achieve the optimal stance. The present invention accomplishes this by clearly providing the golfer 22 with a visual aid for arranging his or her feet in a relative position with respect to the target, each other and with respect to the golf ball 32. Once the longitudinal and transverse guide lines are aligned, the golfer knows that the optimal stance has been obtained and may begin his or her swing.

As further shown in FIG. 3, when the golfer 22 has been properly positioned in the Hogan stance, the longitudinal guide line 28A of the left golf shoe 20A will intersect the central reference axis CA at an angle of 22½° in at least one quadrant. On the other hand, the longitudinal guide line 28B of the right golf shoe 20B will extend parallel to the central reference axis CA. The angular relationship between the left and right longitudinal guide lines is thus the same with respect to the longitudinal reference axes LA and RA, and the central reference axis CA.

Additionally, the transverse guide lines 30A and 30B are particularly useful to aid a golfer 22 in improving his aim prior to swinging a golf club. In this regard, the arrangement of the transverse guide lines 30A and 30B are selected so that their aligned axis, obtained when the optimal stance is obtained, is also in alignment with the intended target area. This feature of the present invention can be appreciated from FIG. 3 which illustrates that the axis of the aligned transverse lines 30A and 30B aids the golfer 22 in aiming toward the target area along arrow T. When the golfer 22 has obtained an optimal stance, the central reference axis CA will extend perpendicular to the axis of target arrow T which extends through the transverse guide lines 30A and 30B between the golfer's feet and the target.

Figure 4:
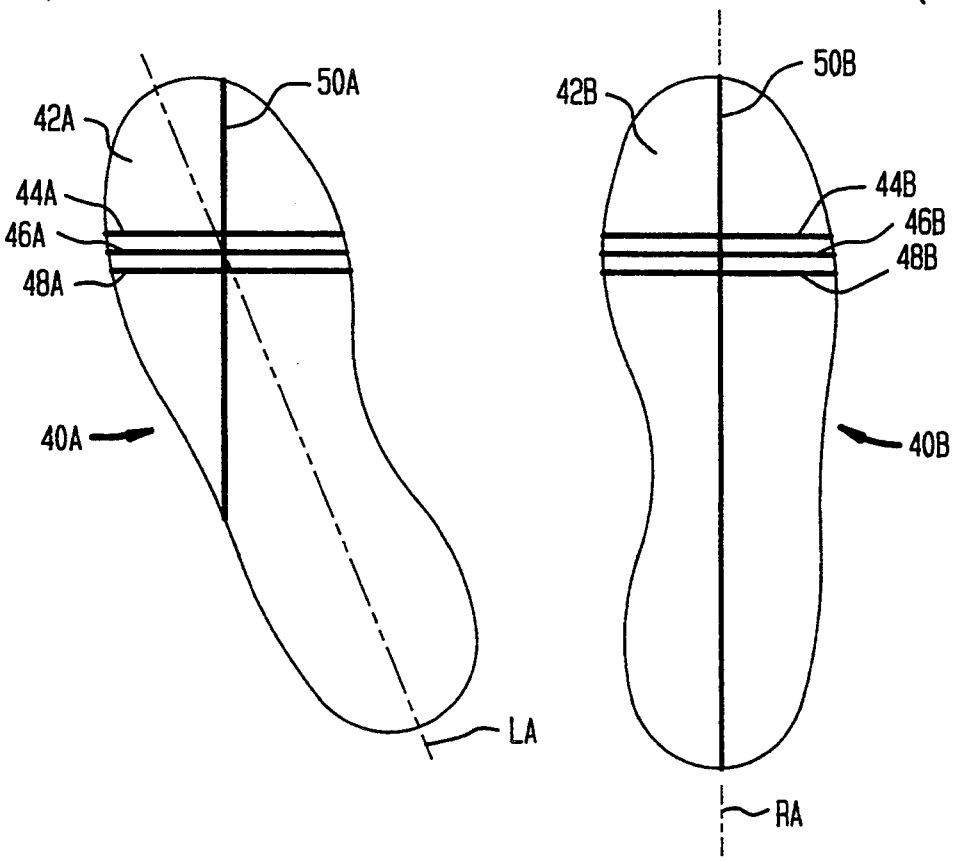
FIG. 4 is a top plan view of a second preferred embodiment of the golf shoes of the present invention for a right handed player after the player's feet are placed in the desired stance.

FIG. 4 depicts an alternate embodiment of the present invention which includes a plurality of transverse lines 44A, 46A and 48A on the upper portion 42A of the left golf shoe 40A and a plurality of transverse lines 44B, 46B and 48B on the upper portion 42B of the right golf shoe 40B. These additional transverse lines may provide a golfer with a clearer reference site than that provided by the single transverse line embodiment establishing the desired stance. One longitudinal line 50A, 50B is shown on the respective left and right golf shoes in the embodiment of FIG. 4. However, more or less transverse or longitudinal lines may be used for aesthetic purposes to create a different appearance on the upper portions of the golf shoes.

Figure 5:
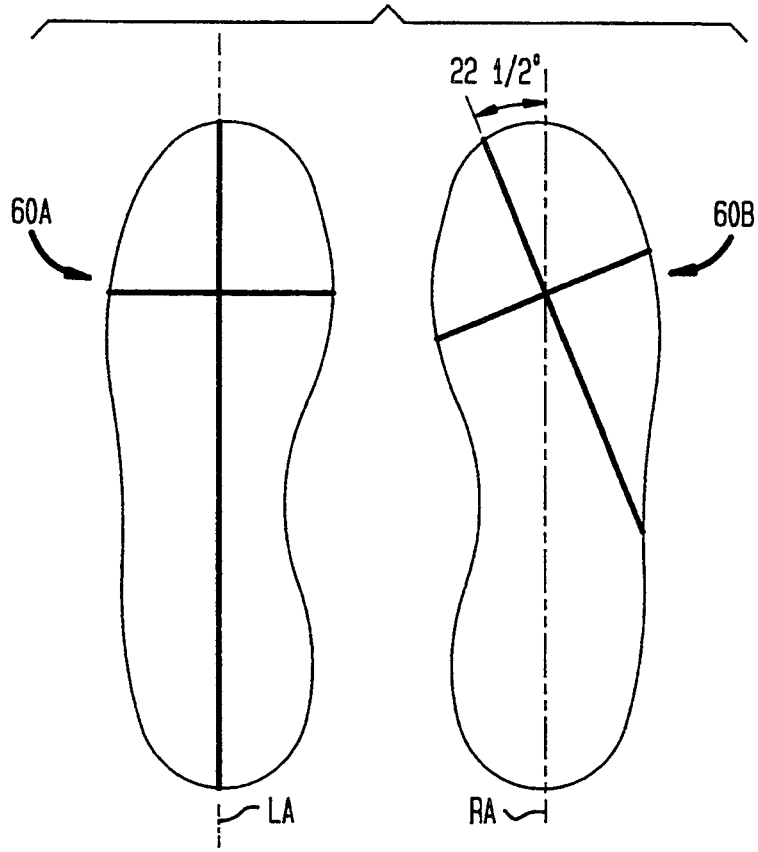
FIG. 5 is a top plan view of a third preferred embodiment of the golf shoes of the present invention for a left handed player before assuming a desired stance.
Figure 6:
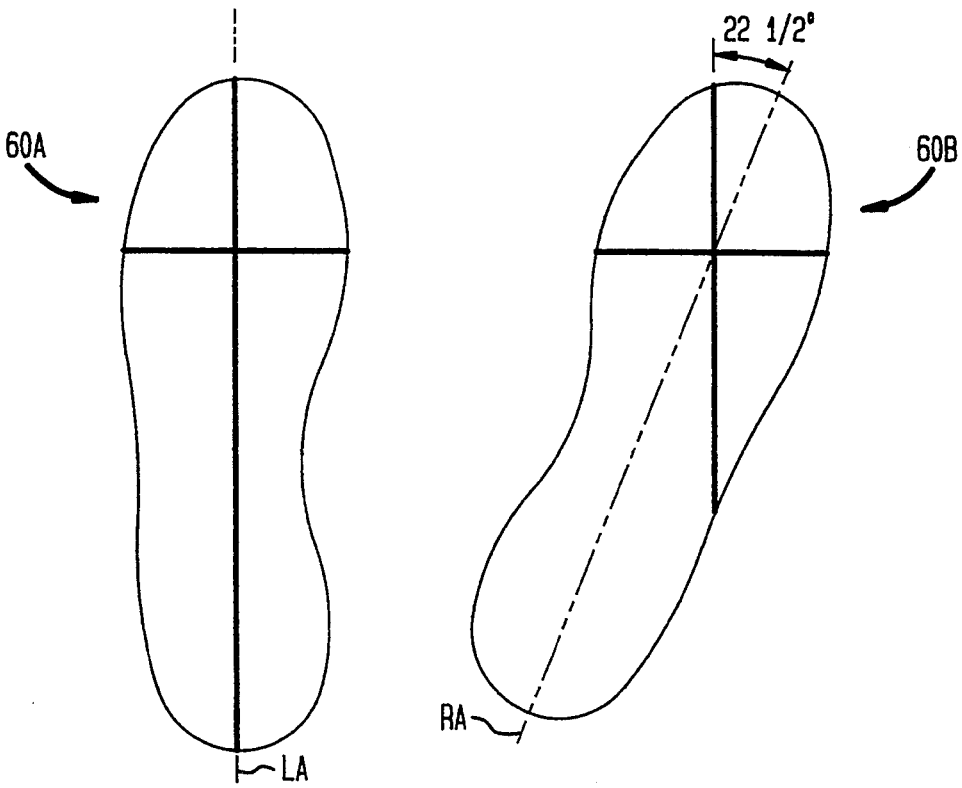
FIG. 6 is a top plan view of the golf shoes shown in FIG. 5 after the player's feet are placed in the desired stance.

FIGS. 5 and 6 illustrate a further embodiment of the present invention for use by left-handed golfers who also prefer the Hogan stance. In this regard, the longitudinal and transverse guide lines on the left and right golf shoes 60A and 60B are simply arranged in an orientation opposite to that shown for a right-handed golfer in FIGS. 1-3. Thus, in the embodiments shown in FIGS. 5 and 6, a left-handed golfer would be required to turn his or her right foot away from the left foot to form an angle of approximately 22½° with respect to a central axis between a golf ball and a selected location on a golfer's body as discussed above.

Figure 7:
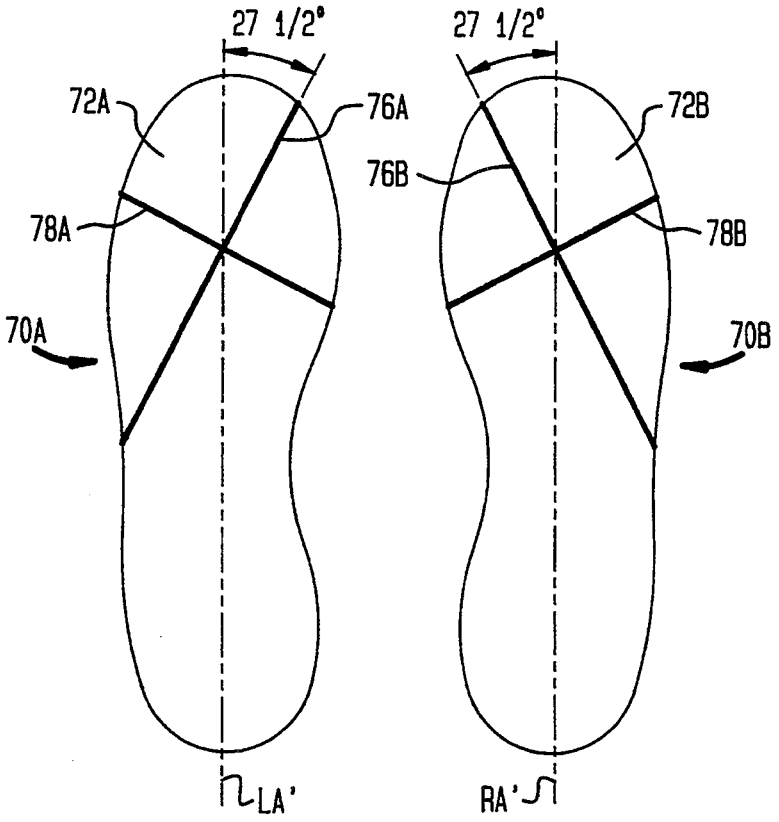
FIG. 7 is a top plan view of a fourth preferred embodiment of the golf shoes of the present invention for both right and left handed players before assuming a desired stance.
Figure 8:
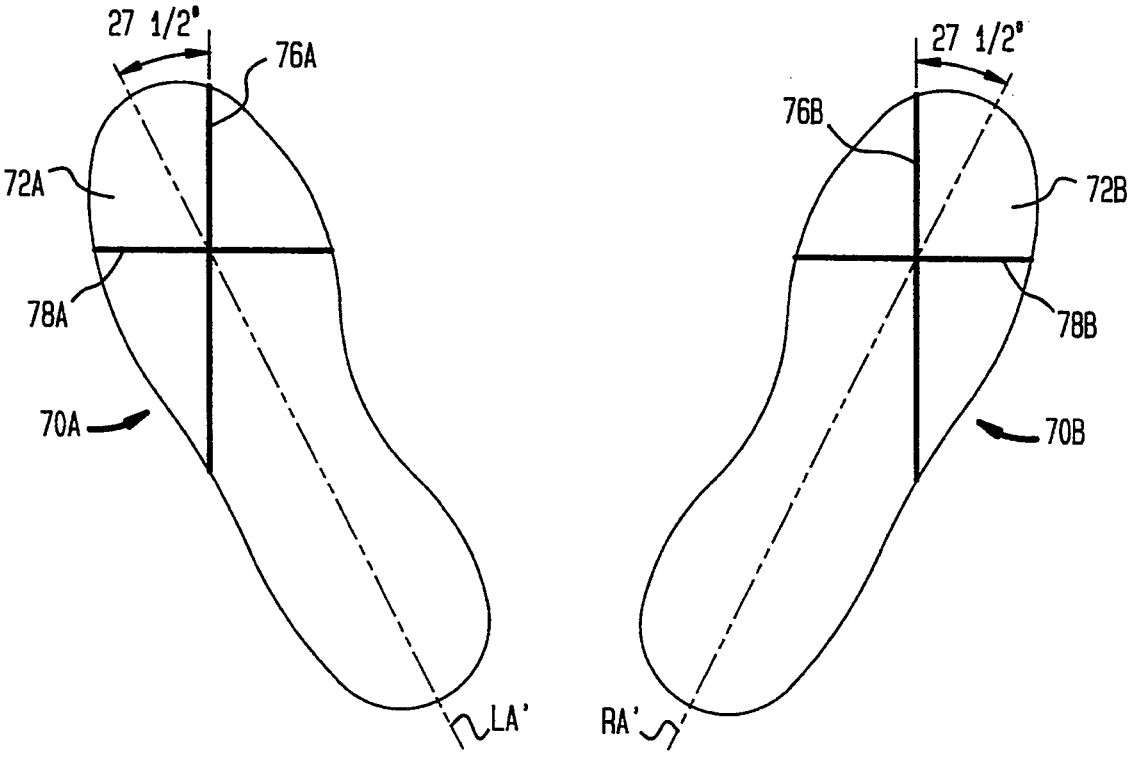
FIG. 8 is a top plan view of the golf shoes shown in FIG. 7 after the player's feet are placed in the desired stance.
Figure 9:
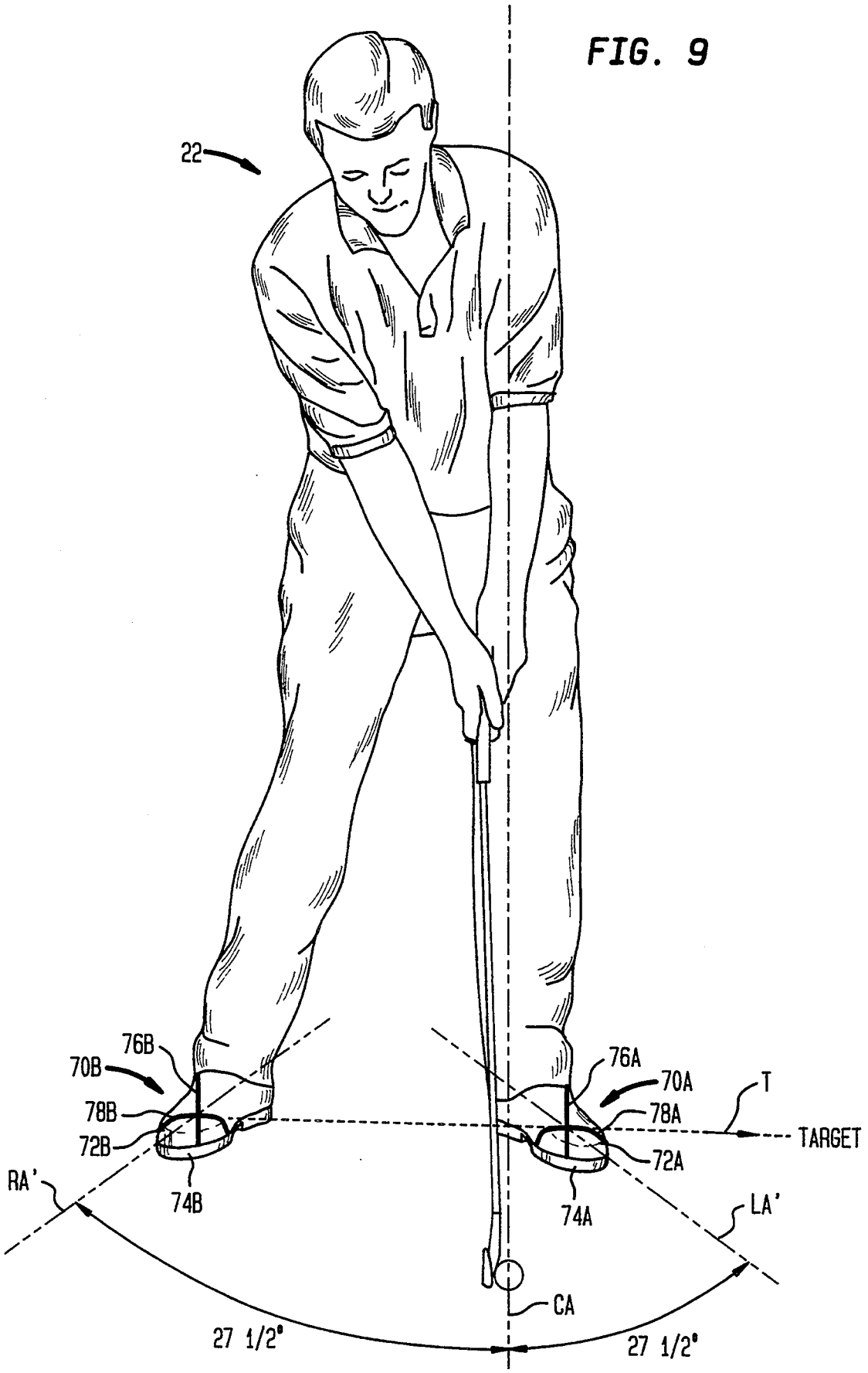
FIG. 9 is a perspective view of the golf shoes shown in FIG. 7 in use by a golfer after the golfer's feet are placed in the desired stance.

A second preferred stance which may be obtained by using the golf shoes of the present invention is the popular Leadbetter stance. When the Leadbetter stance is used, the positioning of a golfer's feet is the same for left and right handed players. FIGS. 7-9 clearly illustrate the orientation of the alignment guide lines required to help a golfer obtain the Leadbetter stance. In this regard, FIG. 7 illustrates an isolated top plan view of a further preferred embodiment of the present invention in which the alignment guide lines are shown in their orientation prior to positioning a golfer's feet in the Leadbetter stance. FIG. 8 depicts the orientation of the alignment guide lines after the golfer's feet have been moved into the proper position to obtain the Leadbetter stance. In this stance, both the left and the right feet should be turned outwardly from each other at an angle of approximately 27½° with respect to a central reference axis CA' (shown in phantom).

In accordance with this embodiment, a left golf shoe 70A includes an upper portion 72A and a sole portion 74A. A longitudinal line 76A and a transverse line 78A are arranged on the upper portion 72A. The longitudinal line 76A forms an angle of about 27½° with respect to the anterior side of a central longitudinal axis LA' (shown in phantom). Similarly, the right golf shoe 70B includes an upper portion 72B and a sole portion 74B. A longitudinal line 76B and a transverse line 78B are arranged on the upper portion 72B. The longitudinal line 76B of the right golf shoe 70B also forms a angle of approximately 27½° with respect to the central longitudinal axis RA' (also shown in phantom), all of which can be appreciated from FIGS. 7 and 8. The orientation of the alignment lines shown in FIG. 7 is that which would be seen in the Leadbetter style golf shoes while the golfer has his or her feet placed in a normal standing position, i.e., before assuming the Leadbetter stance.

Once the Leadbetter stance is obtained, the longitudinal line 76A and the transverse line 78A of the right golf shoe 70 will appear to be parallel with the respective longitudinal line 76B and the transverse line 78B of the right golf shoe 70B as shown in FIGS. 8 and 9. As further shown in FIG. 9, when the golfer 22 has successfully obtained the Leadbetter stance, the aligned transverse lines 78A and 78B will be arranged in an imaginary axis including the target arrow T. Thus, providing the golfer 22 with a means for improving his or her aim prior to swinging the golf club.

Although the particular positioning of a golfer's feet will vary in accordance with the desired stance in the various preferred embodiments, the alignment guide lines of the present invention operate in a similar manner for each of the embodiments of the present invention. That is the longitudinal lines and the transverse lines, if any, should be placed in a parallel position with respect to the corresponding longitudinal or transverse lines on the other golf shoe. This is beneficial as a beginning golfer may wish to experiment with various stances before selecting one that is the most comfortable. Thus, a golfer may purchase both the Leadbetter and Hogan style golf shoes of the present invention and will only need to understand that the longitudinal and transverse lines on the respective left and right golf shoes must be arranged parallel to each other to indicate that the desired optimal stance has been obtained.

It should be appreciated that the number of longitudinal and transverse lines may vary in alternate embodiments while still coming within the scope of the present invention. In this regard, FIG. 10 discloses another preferred embodiment of the golf shoes of the present invention that is intended to help a golfer 22 consistently obtain the Leadbetter stance. In this embodiment, the left golf shoe 80A includes a single longitudinal line 84A on an upper portion 82A thereof and a right golf shoe 80B also includes a single longitudinal line 84B arranged on an upper portion 82B. There are no transverse lines required to achieve alignment of the golf shoes in this embodiment. This embodiment may be desirable for golfers who have a good "eye" and can easily determine that the longitudinal lines 84A and 84B are arranged parallel to each other without the additional aid of transverse lines to accurately determine that an appropriate stance, such as the Leadbetter stance, has been obtained.

Figure 10:
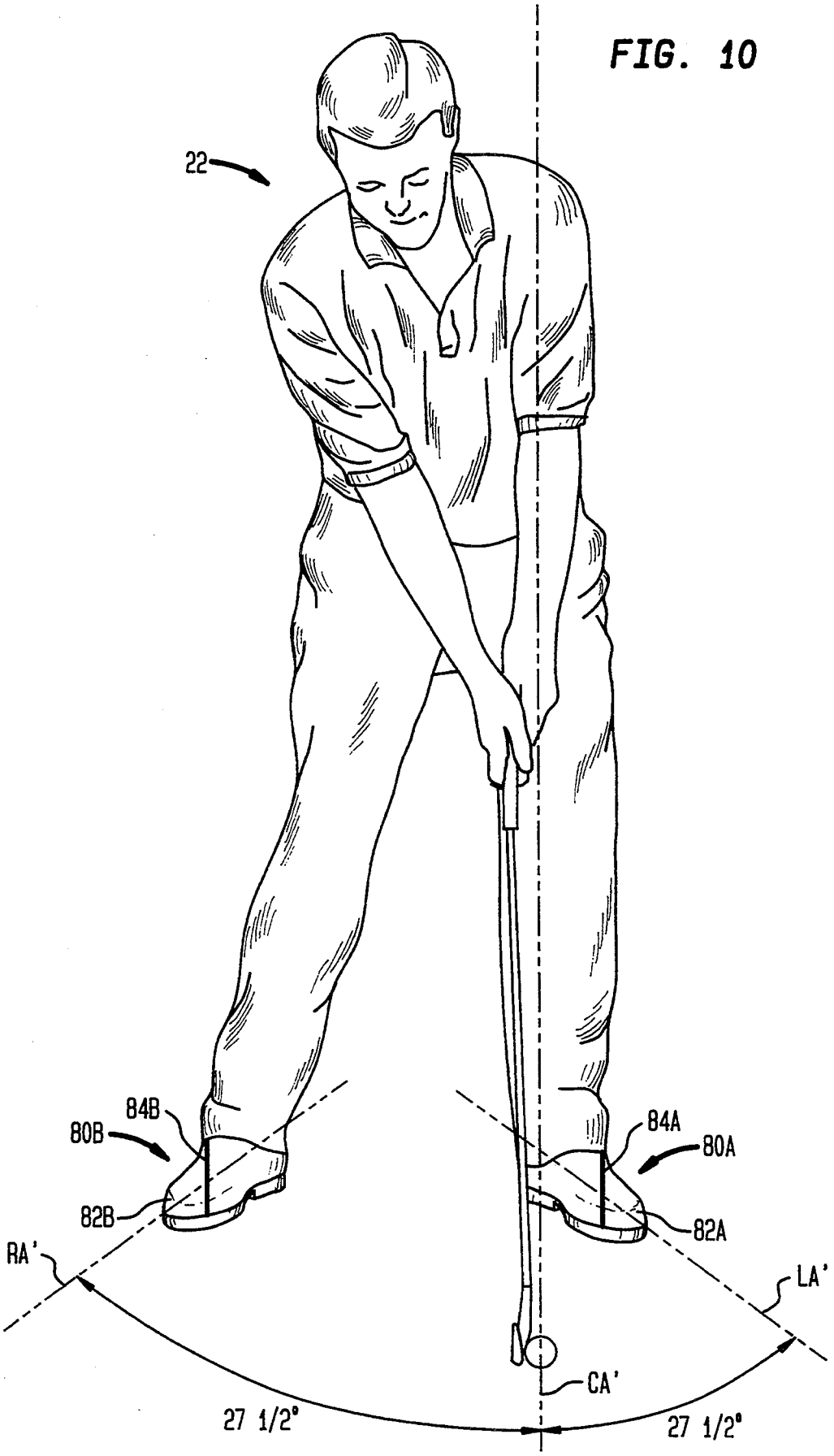
FIG. 10 is a perspective view of a fifth preferred embodiment of the golf shoes of the present invention for both right and left handed players in use by a golfer after the golfer's feet are placed in the desired stance.
Figure 11:
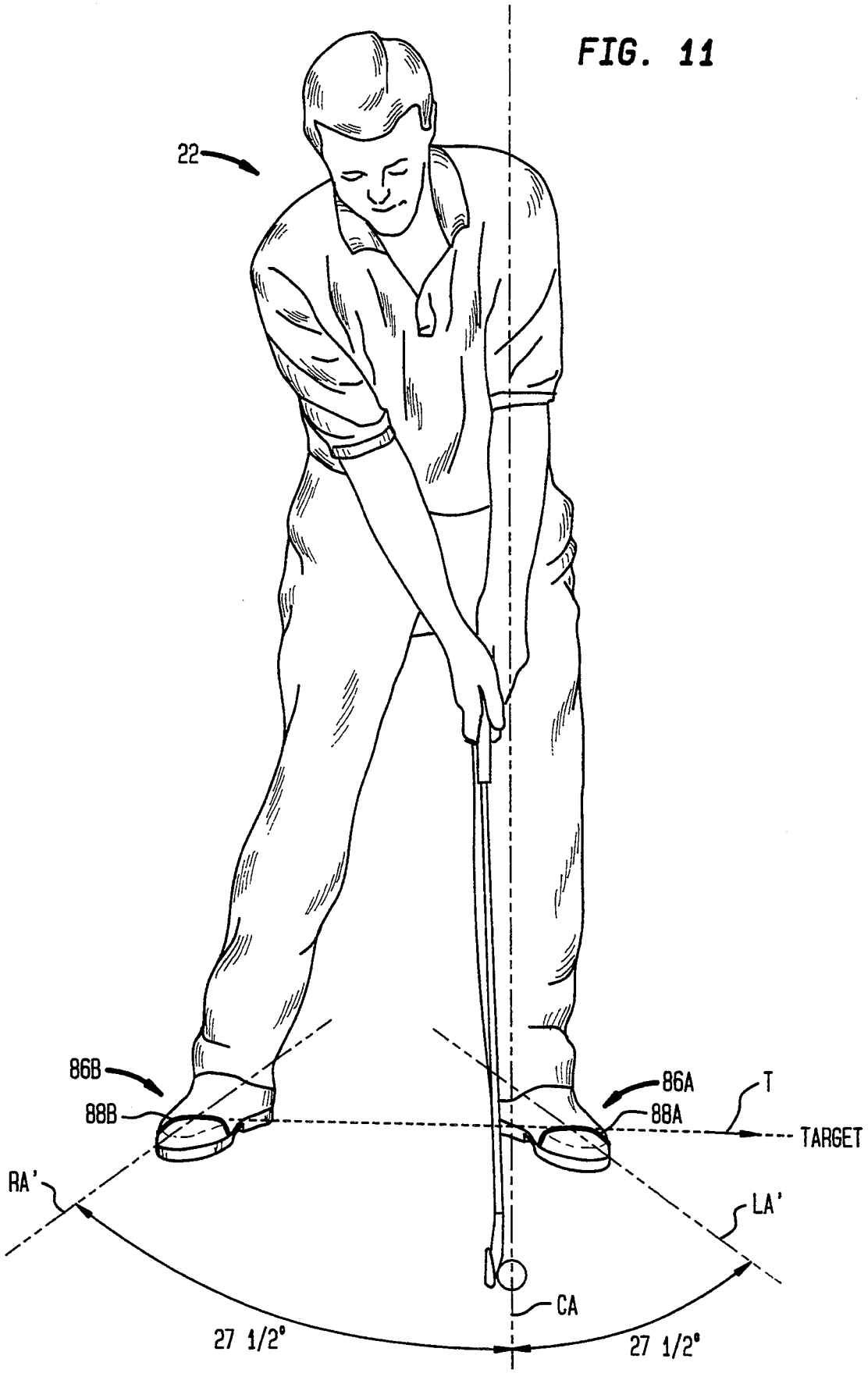
FIG. 11 is a perspective view of a sixth preferred embodiment of the golf shoes of the present invention for both right and left handed players in use by a golfer after the golfer's feet are placed in the desired stance.

FIG. 11 illustrates a further embodiment of golf shoes of the present invention which may be used to aid a golfer 22 in obtaining the Leadbetter stance. In accordance with this embodiment, the left shoe 86A and the right shoe 86B include corresponding transverse lines 88A and 88B, respectively. When proper positioning has been achieved, the transverse guide lines 88A and 88B will be arranged parallel to each other and will be placed in a common axis pointing to the target as evidenced by arrow T. Unlike the embodiments of FIGS. 7–10, no longitudinal lines are needed to obtain proper alignment. However, similar to the embodiments of FIGS. 7–10, the golf shoes of FIG. 11 may also be desirable for use by golfers who can determine when the transverse guide lines 88A and 88B are parallel to each other, without relying on perpendicular longitudinal lines, to verify that an optimal Leadbetter stance has been obtained. Thus, the golf shoes of FIGS. 10 and 11 may be particularly desirable to golfers who have a relatively high experience level and are thus capable of quickly determining that they have established the appropriate stance.

In yet a further preferred embodiment (not shown) golf shoes for aiding a right-handed golfer in establishing the Hogan stance, may not have any lines whatsoever on the right golf shoe and may only include a single longitudinal or transverse line on the left golf shoe. In such an embodiment, the present invention will indicate to an advanced golfer that the Hogan stance has been obtained when the solitary longitudinal or transverse line is arranged parallel to an imaginary longitudinal or transverse axis through the right golf shoe. Such an embodiment may be desirable to golfers who do not wish to wear golf shoes including a plurality of lines as disclosed in the various other embodiments of the present invention.

Figure 12:
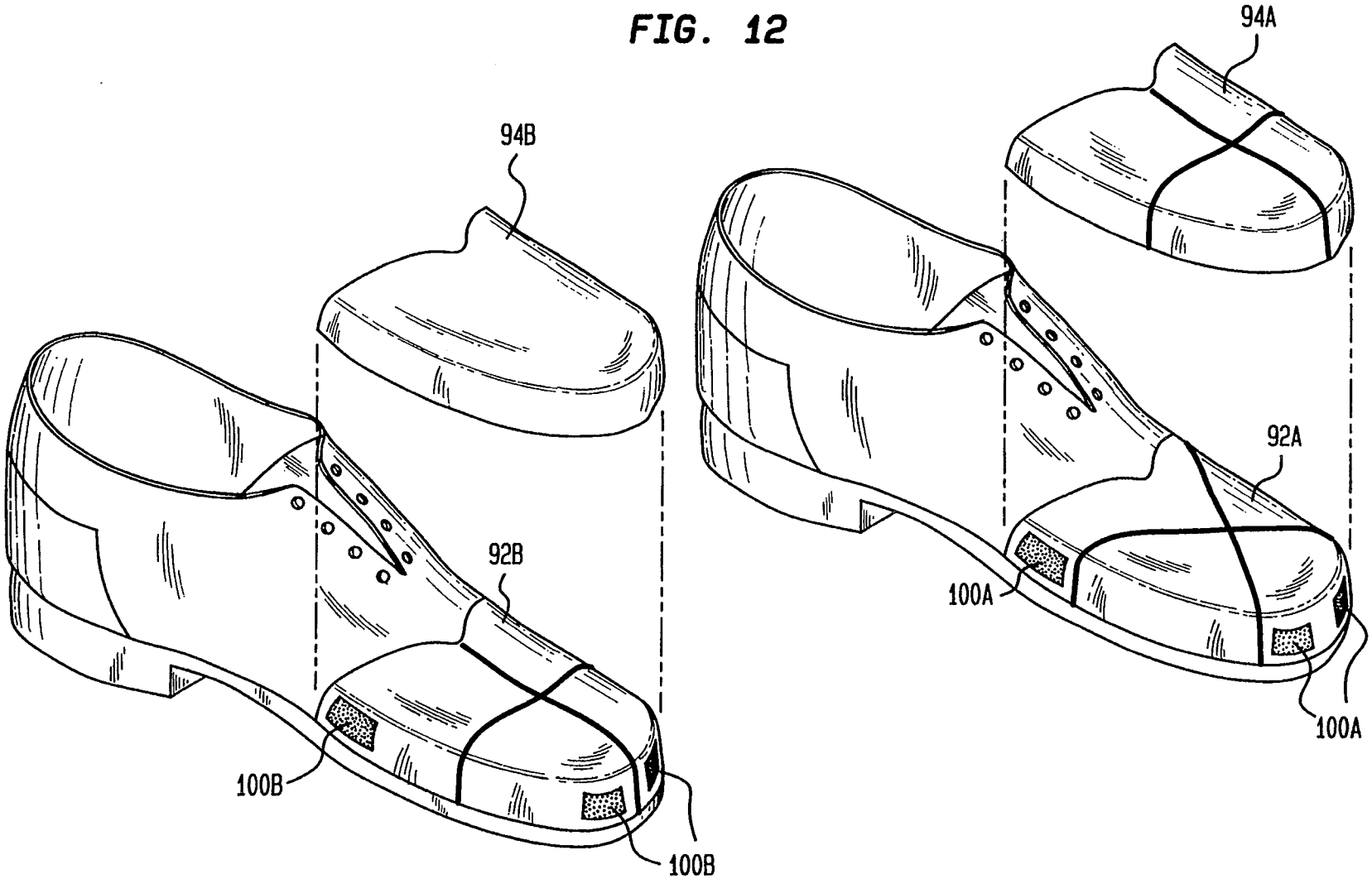
FIG. 12 is an exploded perspective view of a sixth embodiment of the golf shoes of the present invention illustrating optional removable shields.

FIG. 12 discloses another preferred embodiment of the present invention. In this regard, optional removable shields 94A and 94B are disclosed as being selectively attachable and detachable with respect to the upper portions 92A and 92B of left and right golf shoes 90A and 90B, respectively. The shield 94A of the left golf shoe 90A includes a longitudinal line 96A and a perpendicular transverse line 98A which may serve as an alignment means for a right-handed player during putting. Corresponding hook and loop velcro connectors 100A may be used to connect the removable shield to the upper portion 92A of the left golf shoe 90A. The right golf shoe 90B is also equipped with a hook and loop velcro connecting means 100B for optionally attaching a shield 94B over the alignment lines on the upper portion 92B thereof. The right shield 94B is shown in FIG. 10 as having a solid appearance with no design whatsoever so that a golfer can cover the alignment lines of the upper portion 92B of the right golf shoe to avoid any distraction during putting. Additionally, in alternate embodiments, both of the removable shields 94A and 94B may have a solid appearance for experienced golfers who no longer need the alignment means of the present invention as an aid in establishing a desired stance and improved aim.

While the foregoing description and figures are directed toward the preferred embodiments in accordance with the present invention, it should be appreciated that numerous modifications can be made to the structure and orientation of the alignment guide lines on the golf shoes. Thus, such modifications in the materials, structure and arrangement of the disclosed embodiments and the steps of the method of the present invention can be made without departing from the spirit and scope thereof. Accordingly, the foregoing description of the preferred embodiments should be taken by way of illustration rather than by way of limitation with respect to the present invention, which is defined by the claims set forth below.

I claim:

1. A pair of golf shoes comprising an upper portion and a sole portion, said upper portions of each of said pair of golf shoes including a central longitudinal axis extending lengthwise through the center thereof and alignment means arranged on said upper portion of at least one of said golf shoes for aiding a golfer in establishing relative positioning of the golfer's feet with respect to a target, the ball and to each other so that an optimal stance may be obtained to improve a golfer's aim during driving and iron shots, said alignment means including indicia having a orientation offset from a corresponding one of said central longitudinal axes, and at least one first straight line arranged on said upper portion of a right one of said pair of golf shoes and at least one second straight line arranged on said upper portion of a left one of said pair of golf shoes, said at least one first straight line and said at least one second straight line defining corresponding first and second axes, said first and second axes being disposed to intersect each other when said right and left golf shoes are placed parallel to each other, and are arranged parallel to each other to indicate when the golfer's feet are placed in the optimal stance.

2. The golf shoes of claim 1 wherein said alignment means includes a first set of perpendicular longitudinal and transverse linear indicia arranged on said upper portion of a right one of said pair of golf shoes, and a second set of perpendicular longitudinal and transverse linear indicia arranged on said upper portion of a left one of said pair of golf shoes, said first and second sets of perpendicular linear indicia being offset from each other when said central longitudinal axes of said left and right golf shoes are placed parallel to each other, and said first and second sets of perpendicular linear indicia being arranged such that the respective longitudinal and transverse linear indicia thereof are parallel to each other when the golfer's feet are placed in the optimal stance.

3. The golf shoes of claim 2 wherein each of said first and second sets of perpendicular longitudinal and transverse linear indicia comprises one longitudinal line and one transverse line.

4. The golf shoes of claim 2 wherein each of said first and second sets of perpendicular longitudinal and transverse linear indicia comprises a plurality of transverse lines.

5. The golf shoes of claim 1 wherein said at least one first straight line is offset from said central longitudinal axis of said right golf shoe at an angle of about 22½° and wherein said at least one second straight line extends coaxial with said central longitudinal axis of said left golf shoe so that a left handed golfer can obtain the Hogan stance upon placement of said golf shoes in the optimal position.

6. The golf shoes of claim 1 wherein said at least one second straight line is offset from said central longitudinal axis of said left golf shoe at an angle of about 22½° and wherein said at least one first straight line extends coaxial with said central longitudinal axis of said right golf shoe so that a right handed golfer can obtain the Hogan stance upon placement of said golf shoes in the optimal position.

7. The golf shoes of claim 1 wherein said at least one first straight line is offset from said central longitudinal axis of said right golf shoe at an angle of about 27½° and wherein said at least one second straight line is offset from said central longitudinal axis of said left golf shoe at an angle of about 27½° so that a golfer can obtain the Leadbetter stance upon placement of said golf shoes in the optimal position.

8. The golf shoes of claim 1 wherein said alignment means includes connection means for selective attachment and detachment to said upper portion of said golf shoes.

9. The golf shoes of claim 1 further comprising a shield including means for detachably connecting said shield to said upper portion of said golf shoes.

10. The golf shoes of claim 9 wherein said shield includes putting alignment means arranged thereon for facilitating alignment of a golf ball and a selected one of the golf shoes to optimize a golfer's aim during putting.

11. The golf shoes of claim 10 wherein said putting alignment means includes at least one longitudinal line arranged on said upper portion of at least one of said golf shoes whereby the golfer's aim is optimized by aligning said at least one longitudinal line with a golf ball prior to putting.

12. The golf shoes of claim 11 wherein said putting alignment means further includes at least one transverse line perpendicular to said at least one longitudinal line arranged on said upper portion.

* * * * *